US005104300A

United States Patent [19]

Matheson et al.

[11] Patent Number: 5,104,300

[45] Date of Patent: Apr. 14, 1992

[54] LIQUID ADDITIVE METERING

[75] Inventors: John Matheson, Whitechurch; Peter Hassall, Stoke-on-Trent; Colin Smith, Cheadle, all of Great Britain

[73] Assignee: Thomas Willett & Co., Ltd., England

[21] Appl. No.: 622,511

[22] Filed: Dec. 5, 1990

[30] Foreign Application Priority Data

Dec. 5, 1989 [GB] United Kingdom ..... 8927472

[51] Int. Cl.[5] ..... F04B 15/02

[52] U.S. Cl. ..... 417/429; 417/900

[58] Field of Search ..... 417/426, 429, 900

[56] References Cited

U.S. PATENT DOCUMENTS 3,612,732 10/1971 Stephans ..... 417/426
4,189,070 2/1980 Macosko et al. ..... 417/429
4,411,313 10/1983 Johnson et al. ..... 417/426

FOREIGN PATENT DOCUMENTS 1206476 1/1986 U.S.S.R. ..... 417/429
0709426 5/1954 United Kingdom .
1600749 10/1981 United Kingdom .
2165316 4/1986 United Kingdom .

*Primary Examiner*—Richard A. Bertsch
*Assistant Examiner*—Charles G. Freay
*Attorney, Agent, or Firm*—Learman & McCulloch

[57] ABSTRACT

Dosing apparatus for adding a metered quantity of liquid additive to slurry or other flowable material handled by a ram-type positive displacement main pump (10) includes a positive displacement metering pump (32) whose outlet (44) connects into a material carrying portion of the main pump e.g. its inlet (22). The metering pump is driven by a rocking lever (48) connecting it to the main pump ram (14) through adjustment means comprising a lead screw (62) along an arm (50) of the lever for selectively shifting a slide block (68) linked to the metering pump piston rod (42); the slide block being secured against movement on the lever arm once adjustment has been effected by clamping means (74).

8 Claims, 2 Drawing Sheets

LIQUID ADDITIVE METERING

TECHNICAL FIELD

This invention relates to dosing apparatus for metering liquid additives to be mixed with other flowable materials during processing or transfer using a ram-type positive displacement pump. for example in connection with the handling or processing of sludges, slurries and the like involving feed to a filter press for separation of solids and liquid, treatment of sewage or other effluents or waste products, and similar processes.

BACKGROUND OF THE INVENTION

It is known to provide said apparatus having a positive displacement metering pump mechanically linked to the ram of the main pump for positive drive by the latter. one example of such apparatus is described in GB -A- 1600749 and U.S. Pat. No. 4,349,321.

SUMMARY OF THE INVENTION

The object of the present invention is to provide dosing apparatus for accurate selective regulation of the volume of additive delivered, with facility for simple and precise adjustment thereof, and reliable and consistent operation.

According to the invention there is provided dosing apparatus for admixture of a metered quantity of a liquid additive in predetermined proportion by volume to a quantity of slurry or other flowable material pumped by a ram-type positive displacement main pump including a positive displacement metering pump having a displacement element, an inlet for operative connection to a supply of additive, and an outlet for operative connection to means carrying said material; transmission means linking the main pump ram and said displacement element for positive drive of the latter in relationship to movement of said ram including a lever to which said element and ram are connected; and variable stroke control means for selectively varying the effective point of connection of at least one of said elements and ram to the lever whereby said proportion of additive to material can be altered; characterised in that said control means comprises adjusting means on an arm of the lever selectively operable to displace an attachment connecting the displacement element or main ram to said arm longitudinally of the latter, and releasable clamping means for securing said attachment to the arm at any selected position independently of the adjusting means.

Conveniently the lever is a rocking lever with arms extending to opposite sides of its fulcrum, one arm carrying the variable stroke control means with the connection to the metering pump displacement element and the other arm being connected to the main pump ram so that the said element and ram move in opposite directions.

However, other lever arrangements could be used and/or it is also contemplated that the stroke control means could be associated with the connection of the lever to the main pump ram, or possibly could provide for selective adjustment of the effective point of connection of both the metering pump displacement element and the main pump ram to the lever.

The adjusting means of the variable stroke control means may operate mechanically, e.g. it may conveniently include a lead screw extending along the lever arm in threaded engagement with a slide block carrying the connection to said element or ram but it is also contemplated that other forms of adjustment means may be employed e.g. utilising cams or lever linkages for shifting said connection along the lever arm, and that said adjustment means may be power operated e.g. by a servo motor driving said lead screw, possibly with automatic or other remote control.

Said clamping means preferably acts directly between the lever arm and a block or the like to which the displacement element or main ram is connected constituting the attachment thereof to the lever, to secure said attachment positively against displacement relative to the lever arm thus ensuring that once any desired adjustment has been made it will be reliably maintained, and removing any forces or loading from the adjusting means itself during operation of the apparatus.

Conveniently the clamping means is a screw clamp acting transversely of the lever arm but powered clamping means e.g. a hydraulic clamp might be employed and might possibly be operated automatically in conjuction with powered actuation of the adjusting means.

An example of the invention will now be more particularly described with reference to the accompanying drawings.

DETAILED DESCRIPTION OF THE INVENTION

Figure 1:
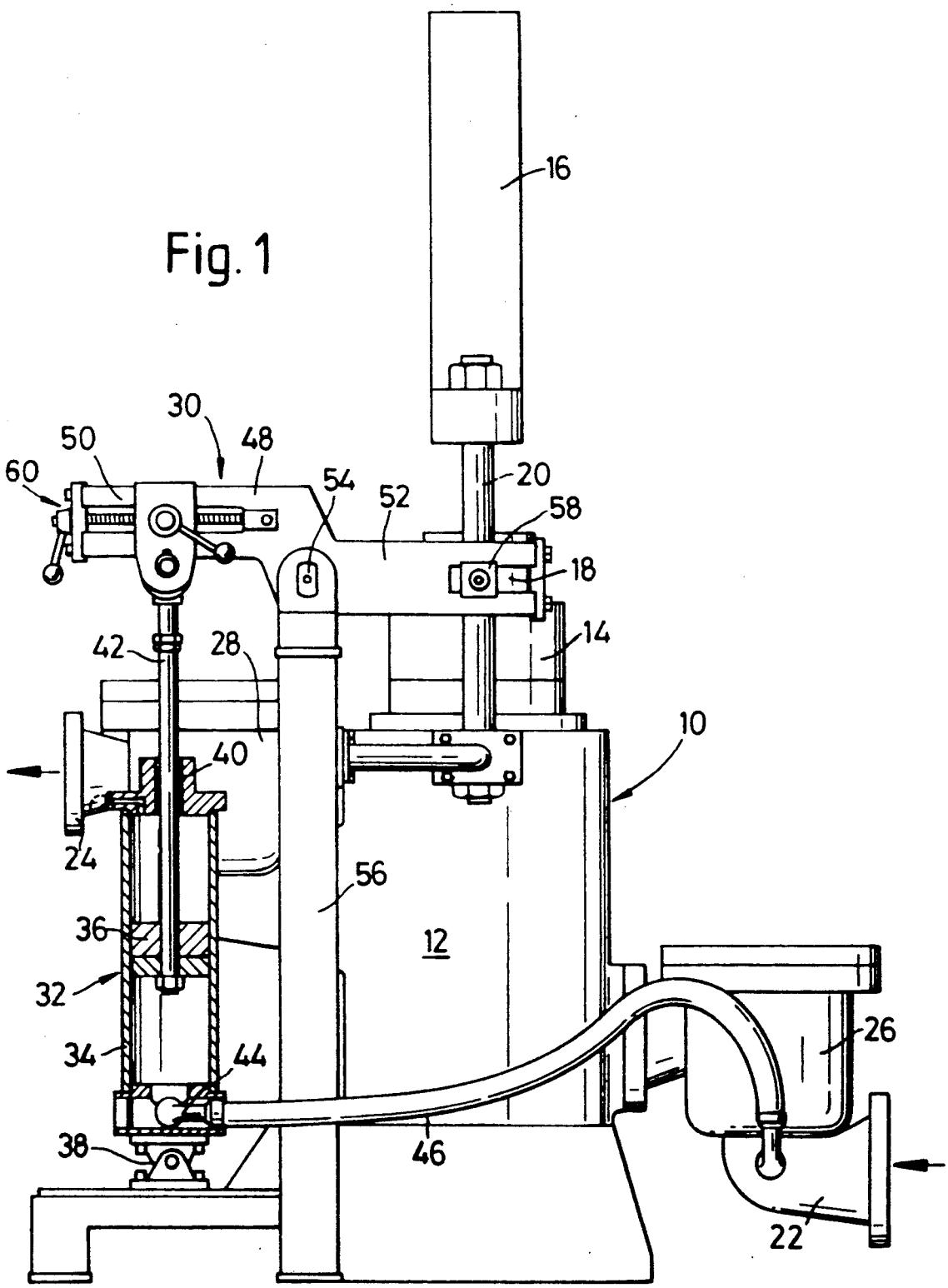
FIG. 1 is a diagrammatic part-sectional elevation of a hydraulically powered ram-type positive displacement pump fitted with a dosing apparatus of the invention.

Referring to FIG. 1 the main pump 10 is of generally conventional construction including a pump body 12 defining a main cylinder coacting with a main ram 14 and powered from a hydraulic drive ram 16 carried above body 12. Ram 16 is connected in line to main ram 14 by a piston rod (not shown) through a cross head 18 in sliding engagement with vertical stanchions or guide bars 20.

Inlet and delivery connections 22, 24 on body 12 communicate with the main pump cylinder by way of respective ball valves 26, 28.

Dosing apparatus 30 is mounted on pump 10 and comprises a single acting positive displacement ram-type metering pump 32 having a cylinder 34 and coacting displacement element or piston 36.

The lower end of cylinder 34 is anchored to fixed structure of the assembly by a pivotal joint 38 to permit a degree of annular movement of pump 32. The upper end of the cylinder includes a cover having a coaxial guide formation 40 through which slides a piston rod 42. Guide formation 40 is of sufficient axial length to provide positive guidance to the rod and increased resistance to wear.

The lower end of cylinder 34 is provided with inlet and outlet connections (only the outlet connection 44 is visible in FIG. 1) fitted with one way valves, the inlet connection being operatively connected to a supply of liquid additive and outlet connection 44 being operatively connected by a heavy duty flexible pipe 46 to the inlet connection 22 of the main pump so that the additive is injected therein upstream of the associated inlet ball valve 26 for admixture with the slurry, sludge or other flowable material as it enters the main pump on the suction stroke of main ram 14.

The metering pump 32 is positively drive connected to the main pump ram 14 by transmission means comprising a generally horizontal lever 48 (shown in greater detail in FIG. 2) having substantially equal first and second arms 50,52 extending to either side of a fulcrum 54 pivoting the lever on a fixed upright 56.

Second arm 52 is pivotally connected to the cross head 18 of the main pump by means of an attachment in the form of a slide block 58 received in a longitudinal slot of arm 52 so as to accommodate the angular movement of the latter in relation to the rectilinear movement of the cross head.

Figure 2:
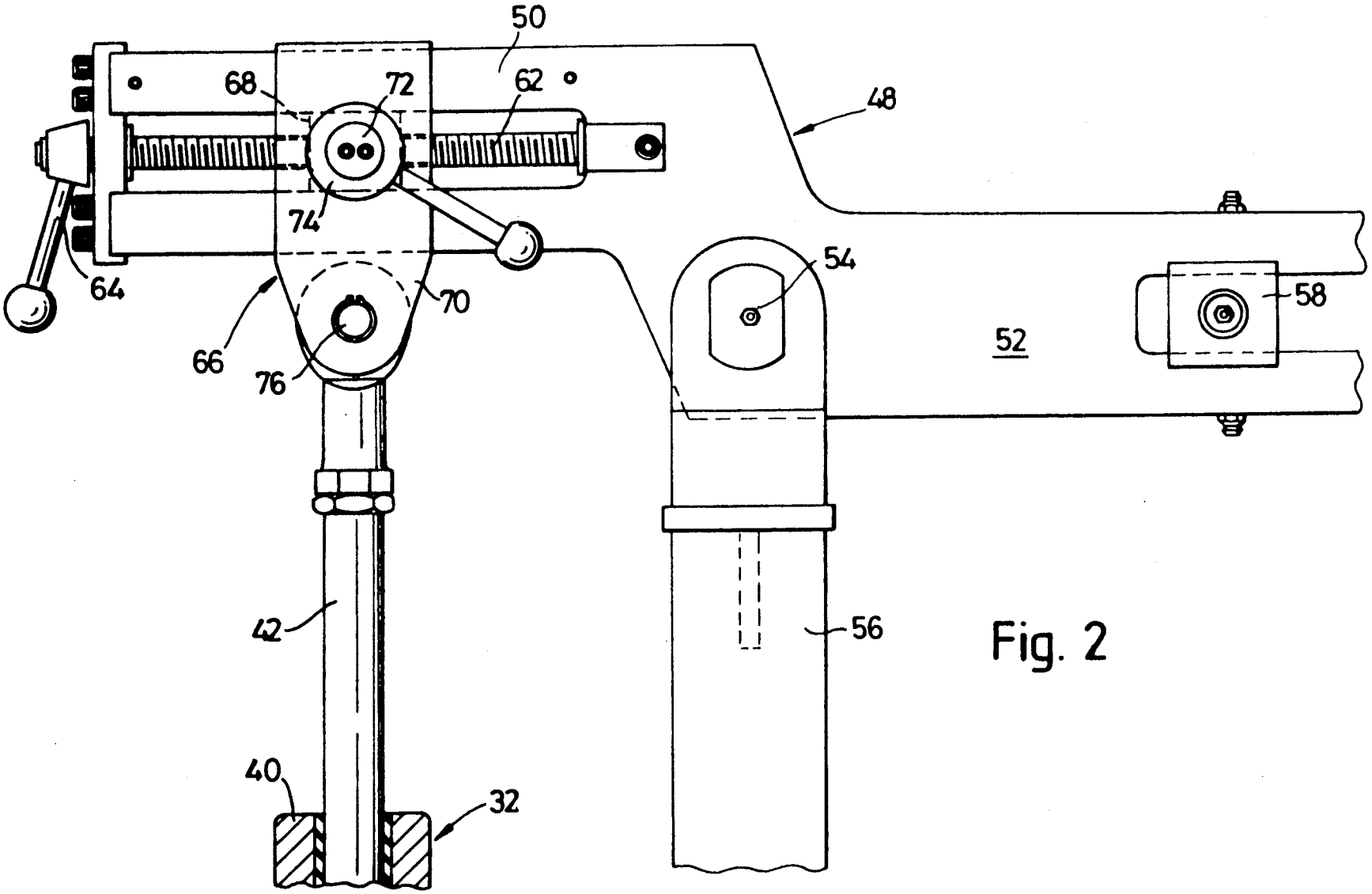
FIG. 2 is a detailed part-sectional elevational of part of said apparatus.

The first arm 50 is connected to piston rod 42 of the metering pump 32 by way of adjusting means 60 best shown in FIG. 2. Said means comprises a lead screw 62 journalled longitudinally of arm 50, the latter being bifurcated to accommodate said screw centrally thereof. The outer end of the screw is provided with a handle 64 for manual rotation thereof.

An attachment 66 comprises a further slide block 68 in threaded engagement with screw 62 and a sliding fit between the limbs of said bifurcated portion, and a pair of side plates 70 (one only visible in the drawings) in opposing relationship to abut the side faces of arm 50 and extend somewhat below its lower edge. Laterally projecting stub shafts 72 fast with block 68 connect plates 70 thereto and the outer ends of said shafts are threaded to receive respective manually operated clamping nuts 74.

When the latter are tightened the attachment 66 is positively secured against longitudinal displacement on arm 50 without any loading on the lead screw 62.

A cross pin 76 extends through the lower part of the pair of plates 70 below arm 50 to provide a pivotal connection with the upper end of the metering pump piston rod 42.

In order to bring the axis of the latter pivotal connection, the axis of fulcrum 54, and the axis of the pivotal connection of first arm 52 with the main pump cross head in line for the most effective operation the second lever arm 50 is cranked upwardly immediately adjacent to fulcrum 54.

In operation as cross head 18 of the main pump rises during the suction stroke of the main ram the piston 36 of metering pump 32 will be driven downwardly so that a precise volume of additive is injected into the main pump inlet connection.

Very fine and positive adjustment of the stroke of the metering pump relative to the displacement of the main pump ram can be effected by the adjusting means 60. The clamping nuts 74 will be slackened to free the attachment 66 for longitudinal movement on lever arm 50 and the lead screw 62 can then be rotated to shift said attachment relative to the arm thus varying the effective distance of the attachment from fulcrum 54. The lead screw could be provided with a Vernier or other scale, possibly calibrated for direct reading of units of volume to assist adjustment.

Once adjustment has been effected the clamping nuts 74 are tightened to secure the attachment 66 directly to arm 50.

As lead screw 62 is not subjected to strain or loading during the operation of the dosing apparatus it can be designed for optimum accuracy, e.g. it can have a fine thread without risk of damage or stripping.

Having now described our invention what we claim is:

1. Positive-displacement heavy-duty pumping apparatus for pressure transfer of flowable materials having a substantial solids content comprising:

a. a main pump having a body defining a main cylinder, a main ram reciprocal in said cylinder, inlet and delivery connections of the body fitted with one-way valve means opening to and from the main cylinder for induced suction inflow of the flowable material to the cylinder on a suction stroke of the main ram and positive displacement pressurized outflow of said material on a delivery stroke of the main ram, and power drive means acting on the main ram for controlled positive movement thereof;

b. a positive displacement metering pump having a reciprocal displacement element, an inlet for operative connection to a supply of additive, and an outlet connected to the inlet connection of the main pump body upstream of the main cylinder; and c. transmission means including a rocking lever drive connecting the main ram with the displacement element for positive movement of the latter in predetermined phased relationship with the main ram whereby a metered dose of additive is injected for admixture with the material as it enters the main cylinder during each suction stroke of the main ram, said transmission means further including variable stroke control means comprising adjusting means on an arm of the lever selectively operable to displace an attachment connecting the displacement element or main ram to said arm longitudinally of the latter so that the effective point of connection thereof with the arm can be varied to regulate the proportion of additive injected into the material in use, and releasable clamping means for positively securing the attachment to the arm at any selected position therealong so as to relieve the adjusting means from loading due to operation of the apparatus once positional adjustment of said attachment has been effected.

2. Positive-displacement heavy-duty pumping apparatus as in claim 1 wherein the lever is a rocking lever having arms extending to opposite sides of its fulcrum, one arm being connected to the metering pump displacement element and the other arm being operatively connected to the main pump ram so that said element and the ram move in opposite directions.

3. Positive-displacement heavy-duty pumping apparatus as in claim 2 wherein said one arm carries the variable stroke control means with the connection to the metering pump displacement element.

4. Positive-displacement heavy-duty pumping apparatus as in claim 2 wherein said other arm carries the variable stroke control means with the connection to the main pump ram.

5. Positive-displacement heavy-duty pumping apparatus as in claim 1 wherein the adjusting means comprises a screw selectively rotatable to displace said attachment.

6. Positive-displacement heavy-duty pumping apparatus as in claim 5 wherein said screw extends along the associated lever arm in threaded engagement with a slide block constituting said attachment.

7. Positive-displacement heavy-duty pumping apparatus as in claim 1 wherein the releasable clamping means acts directly between the attachment and the associated lever arm to secure the attachment at a selected position while removing any forces or loading from the adjusting means.

8. Positive-displacement heavy-duty pumping apparatus as in claim 7 wherein the clamping means is a screw clamp acting transversely of the lever arm.

* * * * *